US005187145A

United States Patent [19]

Kanto et al.

[11] Patent Number: 5,187,145

[45] Date of Patent: Feb. 16, 1993

[54] HEAT TRANSFER SHEETS

[75] Inventors: Jumpei Kanto; Hitoshi Saito; Hiroshi Eguchi; Masayuki Nakamura; Koumei Kafuku; Junji Chiba; Kaoru Suda, all of Tokyo, Japan

[73] Assignee: Dai Nippon Insatsu Kabushiki Kaisha, Japan

[21] Appl. No.: 667,390

[22] PCT Filed: Jul. 26, 1990

[86] PCT No.: PCT/JP90/00953

§ 371 Date: May 1, 1991

§ 102(e) Date: May 1, 1991

[87] PCT Pub. No.: WO91/01890

PCT Pub. Date: Feb. 21, 1991

[30] Foreign Application Priority Data

Aug. 2, 1989 [JP] Japan ..... 1-202228
Jun. 14, 1990 [JP] Japan ..... 2-153912

[51] Int. Cl.[5] ..... B41M 5/035; B41M 5/38

[52] U.S. Cl. ..... 503/227; 128/195; 128/913; 128/914

[58] Field of Search ..... 8/471; 428/195, 913, 428/914; 503/227

[56] References Cited

U.S. PATENT DOCUMENTS 4,788,284 11/1988 Masukawa et al. ..... 544/139
5,026,679 6/1991 Evans et al. ..... 503/227

FOREIGN PATENT DOCUMENTS 0279467 8/1988 European Pat. Off. ..... 503/227
61-31292 2/1986 Japan ..... 503/227
63-205288 8/1988 Japan ..... 503/227
2-668 1/1990 Japan ..... 503/227
1-155693 6/1990 Japan ..... 503/227

OTHER PUBLICATIONS

Patent Abstracts of Japan, vol. 14, No. 227 (C-718) (4170) May 15, 1990 & JP-A-53865 (Konica Corp.) Feb. 22, 1990.

Patent Abstracts of Japan, vol. 14, No. 227 (C-718) (4170) May 15, 1990 & JP-A-2 53866 (Konica Corp.) Feb. 22, 1990.

Patent Abstracts of Japan, vol. 13, No. 331 (C-622)(3679) Jul. 25, 1989 & JP-A-1 110565 (Konica Corp.) Apr. 27, 1989.

*Primary Examiner*—B. Hamilton Hess
*Attorney, Agent, or Firm*—Parkhurst, Wendel & Rossi

[57] ABSTRACT

The heat transfer sheet according to this invention includes a substrate sheet and a dye carrier layer formed on one surface of said substrate sheet, and is characterized in that the dye included in the dye carrier layer is represented by the following general formula (I):

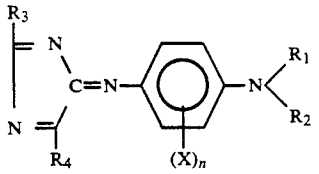

(I)

wherein $R_1$-$R_4$ and X each represent a substituent. According to this invention, it is possible to obtain image representations improved in terms of printing density and clearness as well as storability and resistance to discoloring and browning.

6 Claims, No Drawings

HEAT TRANSFER SHEETS

TECHNICAL FIELD

The present invention relates to a heat transfer sheet. More particularly, the invention has for its object the provision of a heat transfer sheet capable of making image representations improved in terms of the density of developed colors, clearness and fastness properties, especially storability and resistance to discoloring and browning.

BACKGROUND ART

Various heat transfer techniques have so far been known in the art, including a sublimation transfer system wherein a sublimable dye is carried on a substrate sheet as a recording material to form a heat transfer sheet, and that transfer sheet is then overlaid on an image-receiving material dyeable with such a sublimable dye, e.g. a polyester woven fabric to apply heat energy from the back surface of the heat transfer sheet, thereby transferring the sublimable dye onto the image-receiving material.

More recently, it has been proposed to make various full-color images on paper or plastic films, using the aforesaid sublimation type of heat transfer system. In this case, a printer's thermal head is used as heating means to apply very quick heating to transfer a number of three-, four- or multi-color dots onto an image-receiving material, thereby reconstructing a full-color image of the original image with, the multi-color dots. Because the coloring matter used is a dye, the thus formed image is very clear-cut and excels in transparency. Thus that image is improved in terms of the reproducibility of the halftone and gray scale, making it possible to form first-line image representations equivalent to those achieved by conventional offset or gravure printing and comparable to full-color photographs as well.

With the aforesaid heat transfer process, however, the most intractable problems arise in connection with how clearly the resulting image can develop colors, how long it will be well stored and how resistive it will be to discoloring and browning.

In other words, it is required for fast recording that heat energy be applied for as short a time as possible, say, on the order of milliseconds. Thus the sublimable dye and image-receiving material are not well heated within such a short time, rendering it impossible to make images of sufficient density.

In order to accommodate such fast recording, sublimable dyes having superior sulimability have thus been developed. Since dyes excelling in sublimability have generally a low molecular weight, however, they tend to migrate or bleed with time through image-receiving materials after transfer, offering storability problems such as making the resulting images blurry or unclear or causing them to foul surrounding objects.

In order to avert such a problem, it has been proposed to use sublimable dyes having a relatively high molecular weight. However, their rate of sublimation is too low for such high speed recording as mentioned above to make images of such sufficient density as aforesaid.

In addition, because the images are made from dyes, the resulting images are generally inferior in light fastness to pigmented images. In addition, they turn brown or discolor more prematurely than the pigmented images, when exposed to direct sunlight. Such light fastness problems may have been solved to some extent by adding UV absorbers or antioxidants to the dye-receiving layers of image-receiving materials.

However, the discoloring and browning problems arise by light other than direct sunlight as well. For instance, discoloring or browning are likely under indoor light or under such conditions as not directly exposed to light, e.g. in albums, cases or books. These in-room or in-the-dark discoloring or browning problems can never be solved by using general UV absorbers and antioxidants.

DISCLOSURE OF THE INVENTION

It is therefore an object of this invention to provide a heat transfer sheet usable with a heat transfer system making use of sublimable dyes, which can give clear-cut images of sufficient density and allows them to possess superior fastness properties, especially having have excellent storability and resistance to discoloring and browning.

The aforesaid object is achievable by the invention which will be described hereinafter.

More specifically, the present invention provides a heat transfer sheet comprising a substrate sheet and a dye carrier layer formed on one surface of said substrate sheet, characterized in that the dye included in said dye carrier layer is represented by the following general formula (I):

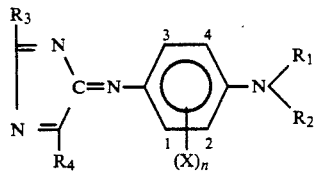

(I)

wherein;

$R_1$ and $R_2$ each stand for an identical or different substituted or unsubstituted alkyl, cycloalkyl, aralkyl or aryl group or an atom or atomic group forming a five- or six-membered ring together with X, provided that $R_1$ and $R_2$ may form together a five- or six-membered ring which may contain an oxygen or nitrogen atom;

$R_3$ and $R_4$ each represent an identical or different substituted or unsubstituted phenyl or naphthyl group or a heterocyclic group containing at least one of oxygen, nitrogen and sulfur atoms, with the proviso that $R_3$ and $R_4$ cannot be phenyl groups at the same time;

X indicates a hydrogen atom, a halogen atom, a cyano group or a nitro group, or an alkyl, cycloalkyl, alkoxy, aryl, aralkyl, acylamino, sulfonylamino, ureido, carbamoyl, sulfamoyl, acyl or amino group which may have a substituent; and n is an integer of 1 or 2.

By using a dye of specific structure, it is possible to provide a heat transfer sheet in which the dye easily migrates onto an image-receiving material even by the application of heat energy within a very short time, thereby obtaining an image representation of high density and superior fastness properties, especially storability and resistance to discoloring and browning.

BEST MODE FOR CARRYING OUT THE INVENTION

The present invention will now be explained in greater detail with reference to its preferred embodiments.

The dyes used in this invention and represented by General Formula (I), for instance, may be easily produced by the alkaline coupling of an imidazole compound expressed by the following general formula (3)—obtained by the reaction of an amidine derivative having the following general formula (1) with an α-bromoacetyl derivative having the following general formula (2)—with an aniline compound expressed by the following general formula (4) in the presence of an oxidizing agent such as silver chloride, ammonium persulfate or potassium ferricyanide.

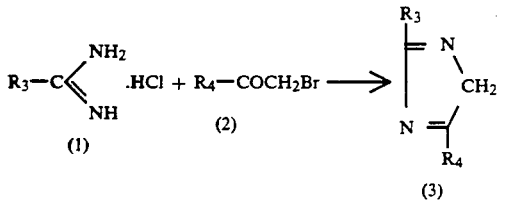

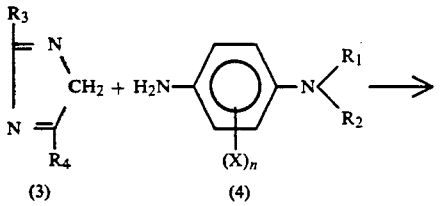

General Formula (I)

wherein $R_1$–$R_4$, X and n have the same meanings as already defined.

The amidine derivatives of General Formula (I) may be synthiesized by generally available processes, e.g. those described in "J. Org. Chem.", 27, 1255 (1962), "J. Org. Ghem. ", 28, 1812 (1963), and other literature. Also, the α-bromoacetyl derivatives of General Formula (2) may be easily synthesized by such a process as set forth in "Aust. J. Chem.", 19, 981 (1966) or "Org. Synth. Coll.", Vol II, 480, (1943).

Reference will now be made to preferable examples of various groups in General Formula (I).

By way of example alone, mentioned as the alkyl group are methyl, ethyl, propyl, butyl, methoxyethyl, ethoxyethyl, hydroxyethyl, β-hydroxypropyl, chloroethyl, cyanomethyl and cyanoethyl groups; as the cycloalkyl group a cyclohexyl; as aralkyl group benzyl and phenetyl groups; as aryl group phenyl, tolyl, halogenophenyl and alkoxyphenyl groups; as the heterocyclic group furyl, thienyl, pyrrolyl, oxazolyl, isoxazolyl, thiazolyl, isothiazolyl, imidazolyl, pyrazolyl, triazolyl, pyranyl, pyridyl, pyridazinyl, pyrimidyl, pyrazinyl, indolyl, indazolyl, quinolyl, quinazolinyl and purinyl; as the halogen atom fluorine, bromine and iodine; as the alkoxyl group methoxy, ethoxy, propoxy and butoxy groups; as the acylamino group acetylamino and benzoylamino groups; as the sulfonylamino group methanesulfonylamino, ethanesulfonylamino and benzenesulfonylamino groups; as the ureido group methylureido, 1,3-dimethylureido and ethylureido groups; as the carbamoyl group methylcarbamoyl, ethylcarbamoyl and phenylcarbamoyl; as the sulfamoyl group methylsulfamoyl, ethylsulfamoyl and phenylsulfamoyl groups; as the acyl group acetyl, propanoyl and benzoyl groups; and as the amino methylamino, ethylamino, propylamino, dimethylamino and diethylamino groups.

When $R_4$ in General Formula (I) is a substituted or unsubstituted thienyl group, images of superior light fastness are then obtainable. Moreover, when $R_3$ and $R_4$ are each an identical or different substituted or unsubstituted thienyl group, images having even more improved light fastness are then attainable.

In the present invention, it is preferred that the dyes have a molecular weight of 400 or more. At a molecular weight less than 400, various fastness properties such as storability and bleed resistance remain insufficient.

When at least one of the groups $R_1$–$R_4$ and X contains such polar substituents as halogen atoms or hydroxyl, cyano, acid amide, sulfonylamide and ester groups, the aforesaid fastness properties are even more improved. Thus, the resulting heat transfer sheet will be free from dye migration (offset), and the like, even when stored in roll form over an extended period of time.

In addition, the heat transfer sheet comprising the aforesaid dye may be used with cyan and magenta sheets for heat transfer to make a full-color image. In this case, it is particularly desired that the half-width of the maximum absorption wavelength of the dye's absorption spectrum is 130 nm or below in terms of reflection, since the development of cyan with a very high purity takes place, making it possible to reproduce full colors more satisfactorily. It is noted that the term "half-width" refers to the width in nm of the absorption wavelength of a dye at 50% of the absorptivity at the maximum absorption wavelength of its visible light absorption spectrum.

By using the aforesaid dye in combination with such yellow and magenta dyes as represented just below, it is possible to make full-color images with a particularly superior color reproducibility.

Yellow Dye

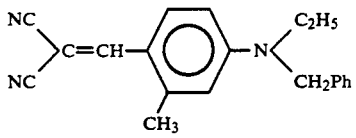

Magenta Dye

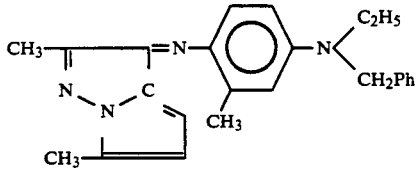

Preferable examples of the dyes well fit for this invention are set out in Table 1, in which the groups $R_{1-4}$, X and n in General Formula (I) are specified with the dyes'molecular weights. It is noted that the groups which $R_3$ and $R_4$ may have are defined in terms of position as follows.

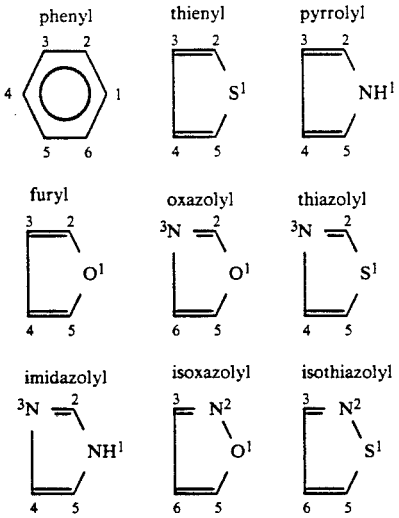

-continued

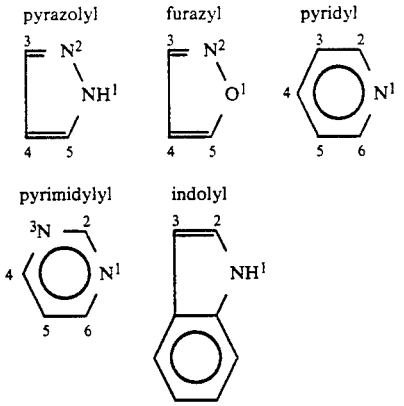

TABLE 1

| No. | $R_1$ | $R_2$ | $R_3$ | $R_4$ | X (n) | M.W. |
|---|---|---|---|---|---|---|
| 1 | $-C_2H_5$ | $-C_2H_5$ | —Ph | 5-chloro-thienyl-2- | 1-$CH_3$ (1) | 434.5 |
| 2 | $-C_2H_5$ | $-C_2H_5$ | —Ph | thienyl-2- | 1-$CH_3$ (1) | 400.0 |
| 3 | $-C_2H_5$ | $-C_2H_4OH$ | —Ph | thienyl-2- | 1-$CH_3$ (1) | 416.0 |
| 4 | $-C_2H_5$ | $-C_2H_5$ | —Ph | 3-acetyl-aminothienyl-2- | 1-H | 443.0 |
| 5 | $-C_2H_5$ | $-C_2H_5$ | —Ph | thienyl-2- | 1-$OC_2H_5$ (1) | 430.0 |
| 6 | $-C_2H_5$ | $-C_2H_5$ | 2-acetylamino-Ph | 2-acetylamino-5-chloro-thienyl-3- | 1-$CH_3$ (1) | 548.0 |
| 7 | $-C_2H_5$ | $-C_2H_5$ | —Ph | thienyl-3- | 1-$CH_3$ (1) | 400.0 |
| 8 | $-C_2H_5$ | $-C_2H_4OH$ | 2-methylcarbamoyl-Ph | 5-cyano-thienyl-3- | 1-$CH_3$ (1) | 498.0 |
| 9 | $-C_2H_5$ | $-C_2H_5$ | thienyl-3- | thienyl-3- | 1-$CH_3$ (1) | 407.0 |
| 10 | $-C_2H_5$ | $-C_2H_5$ | 4-chloro-Ph | thienyl-2- | 1-$NHCOCH_3$ (1) | 477.0 |
| 11 | $-C_2H_5$ | $-C_2H_4Ph$ | 4-cyano-Ph | 5-cyano-thienyl-2- | 1-$CH_3$ (1) | 526.0 |
| 12 | $-C_2H_5$ | $-C_2H_4NHSO_2CH_3$ | thienyl-3- | thienyl-3- | 1-$CH_3$ (1) | 500.0 |
| 13 | $-C_2H_5$ | $-C_2H_5$ | —Ph | thienyl-2- | 1,4-di$CH_3$ (2) | 414.0 |
| 14 | $-C_2H_5$ | —Ph | —Ph | 5-chloro-thienyl-2- | —H (1) | 468.5 |
| 15 | $-C_2H_5$ | $-C_2H_5$ | —Ph | thiazolyl-2- | 1-$CH_3$ (1) | 401.0 |
| 16 | $-C_2H_5$ | $-C_2H_5$ | —Ph | pyrrolyl-2- | 1-$CH_3$ (1) | 382.0 |
| 17 | $-C_2H_5$ | $-C_2H_5$ | —Ph | pyridyl-2- | 1-$CH_3$ (1) | 395.0 |
| 18 | $-C_2H_5$ | $-C_2H_5$ | —Ph | furyl-2- | 1-H (1) | 370.0 |
| 19 | $-C_2H_5$ | $-C_2H_5$ | 2-acetylamino-Ph | 3-acetylamino-furyl-2- | 1-$CH_3$ (1) | 498.0 |
| 20 | $-C_2H_5$ | $-C_2H_4OH$ | furyl-2- | 4-chloro-furyl-2- | 1-$CH_3$ (1) | 424.0 |
| 21 | $-C_2H_5$ | $-C_2H_5$ | —Ph | furyl-3- | 1-$OC_2H_5$ (1) | 414.0 |
| 22 | $-C_2H_5$ | $-C_2H_5$ | furyl-2- | 2-propanoylamino-furyl-3- | 1-H (1) | 431.0 |
| 23 | $-C_2H_5$ | $-C_2H_4CN$ | thienyl-2- | 4-methyl-furyl-3- | 1-$CH_3$ (1) | 429.0 |
| 24 | $-C_2H_5$ | $-C_2H_5$ | furyl-2- | 4-cyano-tjoemu;-2- | 1-$CH_3$ (1) | 415.0 |
| 25 | $-C_2H_5$ | $-C_2H_4Cl$ | thienyl-2- | 5-chloro-thienyl-2- | 1-H (1) | 461.0 |
| 26 | $-C_2H_5$ | $-C_2H_4Ph$ | oxazolyl-2- | 3-acetylamino-thienyl-2- | 1-H (1) | 510.0 |
| 27 | $-C_2H_5$ | $-C_2H_5$ | thiazolyl-2- | 2-acetylamino-thienyl-3- | 1-$CH_3$ (1) | 464.0 |
| 28 | $-C_2H_5$ | $-C_2H_4OH$ | —Ph | pyrrolyl-2- | 1-$CH_3$ (1) | 398.0 |
| 29 | $-C_2H_5$ | $-C_2H_5$ | furyl-2- | —Ph | 1-$CH_3$ (1) | 384.0 |
| 30 | $-C_2H_5$ | $-C_2H_5$ | thienyl-2- | —Ph | 1-$CH_3$ (1) | 400.0 |
| 31 | $-C_2H_5$ | $-C_2H_5$ | thienyl-2- | —Ph | 1-$OC_2H_5$ (1) | 430.0 |
| 32 | $-C_2H_5$ | $-C_2H_5$ | 5-chloro-thienyl-2- | —Ph | 1-H (1) | 420.0 |
| 33 | $-C_2H_5$ | $-C_2H_5$ | oxazolyl-5- | —Ph | 1-$CH_3$ (1) | 385.0 |
| 34 | $-C_2H_5$ | $-C_2H_5$ | —Ph | oxazolyl-2- | 1-$OC_2H_5$ (1) | 415.0 |
| 35 | $-C_2H_5$ | $-C_2H_5$ | —Ph | oxazolyl-4- | 1-H (1) | 371.0 |
| 36 | $-C_2H_5$ | —Ph | 2-chloro-Ph | oxazolyl-2- | 1-$NHCOCH_3$ (1) | 510.5 |
| 37 | $-C_2H_5$ | $-C_2H_5$ | —Ph | oxazolyl-4- | 1-$CH_3$ (1) | 385.0 |
| 38 | $-C_2H_5$ | $-C_2H_5$ | 2-acetylamino-Ph | oxazolyl-5- | 1-$OC_2H_5$ (1) | 472.0 |
| 39 | $-C_2H_5$ | $-C_2H_5$ | 4-methyl-Ph | isoxazolyl-3- | 1-$CH_3$ (1) | 399.0 |
| 40 | $-C_2H_5$ | $-C_2H_5$ | —Ph | isoxazolyl-4- | 1-$CH_3$ (1) | 385.0 |
| 41 | $-C_2H_5$ | $-C_2H_4Ph$ | —Ph | isoxazolyl-5- | 1-$OC_2H_5$ (1) | 491.0 |
| 42 | $-C_2H_5$ | $-C_2H_5$ | —Ph | thiazolyl-2- | 1-H (1) | 387.0 |
| 43 | $-C_2H_5$ | $-C_2H_4OH$ | —Ph | thiazolyl-2- | 1-$CH_3$ (1) | 417.0 |
| 44 | $-C_2H_5$ | $-C_2H_5$ | —Ph | 5-acetylamino-thiazolyl-2- | 1-$CH_3$ (1) | 458.0 |
| 45 | $-C_2H_5$ | $-C_2H_4OH$ | thiazolyl-4- | 5-chloro-thiazolyl-2- | 1-$CH_3$ (1) | 458.5 |
| 46 | $-C_2H_5$ | $-C_2H_5$ | thiazolyl-4- | 5-chloro-thiazolyl-2- | 1-$NHCOCH_3$ | 485.5 |
| 47 | $-C_2H_5$ | $-C_2H_5$ | furyl-2- | 4-cyano-thiazolyl-2- | 1-$CH_3$ (1) | 416.0 |
| 48 | $-C_2H_5$ | $-C_2H_5$ | thienyl-2- | 4-nitro-thiazolyl-2- | 1-$CH_3$ (1) | 452.0 |
| 49 | $-C_2H_5$ | $-C_2H_4Cl$ | —Ph | thiazolyl-4- | 1-H (1) | 421.5 |
| 50 | $-C_2H_5$ | $-C_2H_5$ | 4-methoxycarbonyl-Ph | thiazolyl-5- | 1-$CH_3$ (1) | 459.0 |
| 51 | $-C_2H_5$ | $-C_2H_5$ | 4-hydroxy-Ph | 2-chloro-thiazolyl-5- | 1-$CH_3$ (1) | 451.5 |
| 52 | $-C_2H_5$ | $-C_2H_5$ | —Ph | isoxazolyl-5- | 1-$CH_3$ (1) | 385.0 |
| 53 | $-C_2H_5$ | $-C_2H_5$ | —Ph | imidazolyl-5- | 1-$CH_3$ (1) | 384.0 |
| 54 | $-C_2H_5$ | $-C_2H_5$ | thienyl-2- | imidazolyl-5- | 1-$CH_3$ (1) | 390.0 |

TABLE 1-continued

| No. | $R_1$ | $R_2$ | $R_3$ | $R_4$ | X (n) | M.W. |
|---|---|---|---|---|---|---|
| 55 | $-C_2H_5$ | $-C_2H_5$ | imidazolyl-5- | —Ph | 1-$CH_3$ (1) | 398.0 |
| 56 | $-C_2H_5$ | $-C_2H_5$ | —Ph | pyrazolyl-4- | 1-$CH_3$ (1) | 384.0 |
| 57 | $-C_2H_5$ | $-C_2H_5$ | pyrazolyl-4- | pyrazolyl-4- | 1-$CH_3$ (1) | 374.0 |
| 58 | $-C_2H_5$ | $-C_2H_5$ | pyrazolyl-4- | —Ph | 1-$CH_3$ (1) | 384.0 |
| 59 | $-C_2H_5$ | $-C_2H_5$ | —Ph | furazyl-3- | 1-$CH_3$ (1) | 386.0 |
| 60 | $-C_2H_5$ | $-C_2H_5$ | —Ph | pyrimidyl-5- | 1-$CH_3$ (1) | 396.0 |
| 61 | $-C_2H_5$ | $-C_2H_5$ | —Ph | pyrimidyl-5- | 1-$CH_3$ (1) | 396.0 |
| 62 | $-C_2H_5$ | $-C_2H_5$ | thienyl-2- | thienyl-2- | 1-$CH_3$ (1) | 406.4 |
| 63 | $-C_2H_5$ | $-C_2H_5$ | furyl-2- | thienyl-2- | 1-$CH_3$ (1) | 390.4 |
| 64 | $-C_2H_5$ | $-C_2H_5$ | —Ph | thienyl-3- | 1-$NHCOCH_3$ (1) | 443.4 |
| 65 | $-C_2H_5$ | $-C_2H_5$ | thienyl-2- | thienyl-3- | 1-$CH_3$ (1) | 406.4 |
| 66 | $-C_2H_5$ | $-C_2H_5$ | thienyl-2- | thienyl-3- | 1-$OC_2H_5$ (1) | 436.5 |
| 67 | $-C_2H_5$ | $-C_2H_5$ | thienyl-2- | thienyl-3- | 1-$NHCOCH_3$ (1) | 499.5 |
| 68 | $-C_2H_5$ | $-C_2H_5$ | thienyl-2- | thienyl-3- | —H | 392.4 |
| 69 | $-C_2H_5$ | $-C_2H_5$ | thienyl-2- | thienyl-2- | 1-$NHCOCH_3$ (1) | 449.5 |
| 70 | $-C_2H_5$ | $-C_2H_4OH$ | thienyl-2- | thienyl-2- | —H | 408.4 |
| 71 | $-C_2H_5$ | $-C_2H_4OCH_3$ | thienyl-2- | thienyl-2- | —H | 422.4 |
| 72 | $-C_2H_5$ | $-C_2H_4OCOCH_3$ | thienyl-2- | thienyl-2- | —H | 450.4 |
| 73 | $-C_2H_5$ | $-C_2H_4Ph$ | thienyl-2- | thienyl-2- | —H | 468.5 |
| 74 | $-C_2H_5$ | —Ph | thienyl-2- | thienyl-2- | —H | 440.5 |
| 75 | $-C_2H_5$ | $-C_2H_4CN$ | thienyl-2- | thienyl-2- | —H | 417.4 |
| 76 | $-C_2H_5$ | $-C_2H_4Cl$ | thienyl-2- | thienyl-2- | —H | 426.8 |
| 77 | $-C_2H_5$ | $-C_2H_4NHCOCH_3$ | thienyl-2- | thienyl-2- | —H | 449.4 |
| 78 | $-C_2H_5$ | $-C_2H_4NHCH_3$ | pyridyl-2- | thienyl-2- | —H | 416.2 |
| 79 | $-C_2H_5$ | $-C_2H_5$ | thienyl-2- | 5-bromo-thienyl-2- | —H | 471.3 |
| 80 | $-C_2H_5$ | $-C_2H_5$ | thienyl-2- | 5-cyano-thienyl-2- | —H | 417.4 |
| 81 | $-C_2H_5$ | $-C_2H_5$ | benzothiazolyl-2- | thienyl-2- | —H | 443.5 |
| 82 | $-C_2H_5$ | $-C_2H_5$ | indolyl-2- | thienyl-2- | —H | 424.4 |
| 83 | $-C_2H_5$ | $-C_2H_5$ | pyrazolyl-2- | thienyl-2- | 1-$CH_3$ (1) | 376.3 |
| 84 | $-C_2H_5$ | $-C_2H_5$ | —Ph | thienyl-2- | —H | 384.4 |

The heat transfer sheet of this invention is characterized by using such a specific dye as aforesaid, and may otherwise be similar to heat transfer sheets so far known in the art.

The substrate sheet which is used for the present heat transfer sheet containing the aforesaid dye may be made of any known material having some heat resistance and strength. For instance, use may be made of paper, various forms of processed paper, polyester films, polystyrene films, polypropylene films, polysulfone films, polycarbonate films, aramid films, polyvinyl alcohol films, cellophane and so on, all having a thickness of 0.5 to 50 μm, preferably 3–10 μm. Particular preference is given to the polyester films.

In the dye carrier layer formed on the surface of such a substrate sheet as aforesaid, the dye expressed by General Formula (I) is carried by any desired binder resin.

For carrying the aforesaid dye, binder resins so far known in the art may all be used. By way of example, use may preferably be made of cellulosic resins such as ethylcellulose, hydroxyethylcellulose, ethylhydroxycellulose, hydroxypropylcellulose, methylcellulose, cellulose acetate and cellulose acetate butyrate; and vinylic resins such as polyvinyl alcohol, polyvinyl acetate, polyvinyl butyral, polyvinyl acetacetal, polyvinyl pyrrolidone and polyacrylamide. Among others and in consideration of heat resistance, dye migration and the like, particular preference is given to polyvinyl butyral and polyvinyl acetal.

While such a dye carrier layer is basically made of the aforesaid material, it may additionally contain various additives such as those heretofore used, as occasion demands.

In order to form such a dye carrier layer, the aforesaid dye and binder resin may preferably be dissolved or dispersed in a suitable solvent, optionally together with other desired components, to prepare a coating liquid or ink for forming the carrier layer. The coating liquid or ink is then coated on the aforesaid substrate sheet, followed by drying.

The thus formed carrier layer has a thickness of 0.2 to 5.0 μm, preferably about 0.4 μm to about 2.0 μm, with the aforesaid dye suitably accounting for 5 to 70% by weight, preferably 10–60% by weight of the carrier layer.

While the heat transfer sheet according to this invention may be useful as such for heat transfer, its dye carrier layer may additionally be provided on the surface with an anti-tack or release layer. By the provision of such a layer, it is possible to prevent the heat transfer sheet from sticking to an associated image-receiving material during heat transfer and so make images of much more improved densities by using much higher heat transfer temperatures.

Considerable release effects may be obtained by mere deposition of anti-tack inorganic powders. However, preference is given to a 0.01 to 5-μm, preferably 0.05–2-μm thick release layer made of resins excelling in releasability, such as silicone, acrylic or fluorinated polymers.

It is understood that sufficient release effects are also obtainable, even when such inorganic powders or releasable polymers as aforesaid are incorporated in the dye carrier layer.

In addition, such heat transfer sheet may be provided on its back with a heat-resistant layer to prevent the heat of a thermal head from having an adverse influence on it.

The image-receiving material which is used to form an image with such a heat transfer sheet as aforesaid may be made of any material with its recording surface being receptive with respect to the aforesaid dye. When it is made of dye receptivity-free materials such as paper, metals, glass or synthetic resins, it may be provided on at least one surface with a dye-receptive layer.

Image-receiving materials which may not be provided with any dye-receptive layer, for instance, may include fibers, woven fabrics, films, sheetings, and the like, made of polyolefinic resins such as polypropylene; halogenated polymers such as polyvinyl chloride and polyvinylidene chloride; vinylic polymers such as polyacrylic ester; polyester base resins such as polyethylene terephthalate and polybutylene terephthalate; polystyrene base resins; polyamide base resins; copolymeric resins such as those of olefins, e.g. ethylene or propylene with other vinyl monomers; ionomers; cellulosic resins such as cellulose diacetate; and polycarbonates.

Particular preference is given to polyester sheets or films, or processed paper having a polyester layer. Even dye receptivity-free materials inclusive of paper, metals and glass may be formed into image-receiving materials by coating a solution or dispersion of such dye-receptive resins as aforesaid on their recording surfaces, followed by drying, or laminating films of those resins on their recording surfaces.

Even with the aforesaid dye-receptive image-receiving materials, better results are obtained if they are provided with a dye-receiving layer of a resin better in dye receptivity than them, as is the case with paper.

The thus formed dye receiving-layer may be made of a material or materials, and may contain various additives as well, provided that they- offer no impediment to the achievement of the desired object.

Such a dye-receiving layer may have any desired thickness, but is generally in the range of 3 to 50 μm in thickness. Also, it may be formed into a continuous coat, or a discontinuous coat with resin emulsions or dispersion.

Constructed basically as aforesaid, such an image-receiving material may serve well by itself. However, anti-tack inorganic powders may be incorporated in the aforesaid image-receiving material or its dye-receiving layer, whereby more improved heat transfer can be carried out even at elevated heat transfer temperatures, since the heat transfer sheet is more unlikely to stick to the image-receiving material. Particularly preferable to this end is finely divided silica.

In place of or in combination with such inorganic powders as silica powders, resins having increased releasability, e.g. such resins as aforesaid, may be added. Particularly preferable releasable polymers are set products of silicone compounds, e.g. set products comprising epoxy and amino-modified silicone oils. Such a releasant may preferably account for about 0.5 to 30% by weight of the dye-receiving layer.

The image-receiving material used may have such inorganic powders as aforesaid deposited onto, or a layer of such a releasant as one having increased releasability formed on, the surface of its dye-receiving layer, thereby enhancing the anti-tack effects.

Such a release layer produces sufficient effects at a thickness of about 0.01 μm to about 5 μm, preventing the heat transfer sheet from sticking to the dye-receiving layer of the image-receiving material, while improving its dye receptivity.

Known heat energy applicator means may all be used for heat transfer with the aforesaid heat transfer sheet of this invention and such an image-receiving material as aforesaid. For instance, the desired object is well attainable by applying a heat energy of about 5 mJ/mm$^2$ to about 100 mJ/mm$^2$ a time controlled by recording equipment such as a thermal printer (e.g. Video Printer VY-100 made by Hitachi, Ltd., Japan)

According to this invention as described above, the dye used to construct the present heat transfer sheet has superior heat migration and allows the dye to be well received by the image-receiving material and the image-receiving material to develop color, but does not bleed through the image-receiving material. This is because, in spite of having a molecular weight much higher than that—a matter of 150 to 250—of sublimable dyes used for conventional heat transfer sheets, the present dye has a specific structure and a substituent at a specific position.

While the resulting image is made from the dye, yet it does not give rise to the discoloring and browning problems under indoor light or in such states as not directly exposed to light, e.g. in albums, cases or books.

Thus the image representation made with the heat transfer sheet of this invention has much superior fastness properties, especially resistance to migration and contamination, and such improved resistance to dicoloring and browning, that even when stored over an extended period of time, it will be most unlikely to fray, contaminate other objects and lose its clearness. All the problems incidental to the prior art can thus be solved.

The present invention will now be explained more illustratively with reference to Reference Examples, Examples and Comparative Examples, wherein unless otherwise stated, "parts" and "%" are given by weight.

REFERENCE EXAMPLE 1

Twenty (20.0) g of benzamidine hydrochloride dissolved in water were neutralized with sodium hydroxide, and was thereafter extracted under agitation with dichloromethane. Ten (10.0) g of 2-bromoacetyl-5-chlorothiophene were added to the resulting organic or dichloromethane phase, followed by 3-hour heating and reflux under agitation. After the completion of the reaction, crystals were precipitated by cooling and filtered out to obtain 8.5 g of 2-phenyl-4-[2-(5-chlorothienyl)]-imidazole (with a melting point of 181° C. to 182° C. and in a 79% yield).

Ten (10.0) g of the aforesaid imidazole compound were dissolved in a mixed ethyl acetate/ethanol solvent, and a total of 9.7 g of an aqueous solution of soda carbonate and hydrochloric acid 2-amino-5-diethylaminotoluene were successively added to the resulting solution. After that, 21.6 g of ammonium persulfate were added dropwise. Following the completion of the dropwise addition, the reaction was allowed to occur at room temperature for 1 hour to precipitate crystals, which were then filtered out. The obtained crystals were recrystallized from ethyl acetate to obtain (in an 87% yield) a dye represented by the following structural formula or specified under No. 1 in Table 1. The dye had a melting point of 167° C. to 168° C. and showed a maximum absorption wavelength of 650 nm (in ethyl acetate).

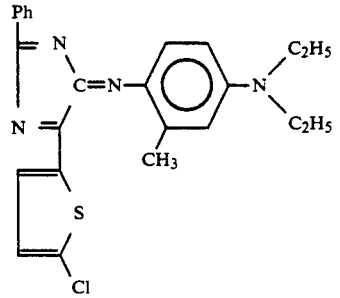

REFERENCE EXAMPLE 2

Other dyes mentioned in Table 1 were obtained by following the procedures of Reference Example 1, provided that the starting materials corresponding to said other dyes were used.

EXAMPLE 1

A dye carrier layer-forming ink composition comprising the following components was prepared and, then, coated on a 6-μm thick polyethylene terephthalate subjected on its back surface to a heat-resistant treatment to a dry coverage of 1.0 g/m$^2$. Subsequent drying gave a heat transfer sheet according to this invention.

| | |
|---|---|
| Dye mentioned in Table 1 | 3 parts |
| Polyvinyl butyral resin | 4.5 parts |
| Methyl ethyl ketone | 46.25 parts |
| Toluene | 46.25 parts |

However, when the dye was insoluble in the aforesaid composition, suitable solvents such as DMF, dioxane and chloroform were used.

Next, a synthetic paper (Yupo FPG #150 made by Oji Yuka K.K.) serving as a substrate sheet was coated on one surface with a coating solution composed of the following components to a dry coverage of 10.0 g/m$^2$. Subsequent 30-minute drying at 100° C. gave an image-receiving material.

| | |
|---|---|
| Polyester resin (Vylon 200 made by Toyobo Co., Ltd., Japan) | 11.5 parts |
| Vinyl chloride/vinyl acetate copolymer (VYHH made by UCC) | 5.0 parts |
| Amino-modified silicone (KF-393 made by The Shin-Etsu Chemical Co., Ltd., Japan) | 1.2 parts |
| Epoxy-modified silicone (KF-22-343 made by The Shin-Etsu Chemical Co., Ltd.) | 1.2 parts |
| Methyl ethyl ketone/toluene/cyclohexanone at a weight ratio of 4:4:2 | 102.0 parts |

The heat transfer sheet of this invention was overlaid on the aforesaid image-receiving material, while the former's dye carrier layer was in opposition to the latter's dye-receiving layer. Recording was performed from the back surface of the heat transfer sheet at a head application voltage of 10 V for a printing time of 4.0 msec. The results are reported in Table 2.

TABLE 2

| Dyes | Density of Developed colors | Storability: Resistance to heat migration | Storability: Light fastness | Color tones |
|---|---|---|---|---|
| 1 | 2.50 | ○ | ○ | blue |
| 2 | 2.57 | ○ | ○ | blue |
| 3 | 2.21 | ○ | ○ | blue |
| 4 | 2.49 | ○ | ○ | blue |
| 5 | 2.45 | ○ | ○ | blue |
| 6 | 2.27 | ○ | ○ | blue |
| 7 | 2.57 | ○ | ○ | blue |
| 8 | 2.14 | ○ | ○ | blue |
| 9 | 2.54 | ○ | ◎ | blue |
| 10 | 2.46 | ○ | ○ | blue |
| 11 | 2.22 | ○ | ○ | blue |
| 12 | 2.16 | ○ | ◎ | blue |
| 13 | 2.48 | ○ | ○ | blue |
| 14 | 2.25 | ○ | ○ | blue |
| 15 | 2.38 | ○ | ○ | blue |
| 16 | 2.61 | ○ | ○ | blue |
| 17 | 2.62 | ○ | ○ | blue |
| 18 | 2.56 | ○ | Δ | blue |

TABLE 2-continued

| Dyes | Density of Developed colors | Storability: Resistance to heat migration | Storability: Light fastness | Color tones |
|---|---|---|---|---|
| 19 | 2.21 | ○ | Δ | blue |
| 20 | 2.17 | ○ | Δ | blue |
| 21 | 2.46 | ○ | Δ | blue |
| 22 | 2.47 | ○ | Δ | blue |
| 23 | 2.43 | ○ | Δ | blue |
| 24 | 2.48 | ○ | Δ | blue |
| 25 | 2.44 | ○ | ◎ | blue |
| 26 | 2.34 | ○ | ○ | blue |
| 27 | 2.34 | ○ | ○ | blue |
| 28 | 2.19 | ○ | Δ | blue |
| 29 | 2.49 | ○ | Δ | blue |
| 30 | 2.49 | ○ | ○ | blue |
| 31 | 2.32 | ○ | ○ | blue |
| 32 | 2.37 | ○ | ○ | blue |
| 33 | 2.47 | ○ | Δ | blue |
| 34 | 2.45 | ○ | Δ | blue |
| 35 | 2.66 | ○ | Δ | blue |
| 36 | 2.23 | ○ | Δ | blue |
| 37 | 2.58 | ○ | ○ | blue |
| 38 | 2.27 | ○ | ○ | blue |
| 39 | 2.63 | ○ | ○ | blue |
| 40 | 2.51 | ○ | ○ | blue |
| 41 | 2.26 | ○ | ○ | blue |
| 42 | 2.57 | ○ | ○ | blue |
| 43 | 2.18 | ○ | ○ | blue |
| 44 | 2.30 | ○ | ○ | blue |
| 45 | 2.08 | ○ | ○ | blue |
| 46 | 2.32 | ○ | ○ | blue |
| 47 | 2.56 | ○ | Δ | blue |
| 48 | 2.21 | ○ | ○ | blue |
| 49 | 2.56 | ○ | ○ | blue |
| 50 | 2.33 | ○ | ○ | blue |
| 51 | 2.06 | ○ | ○ | blue |
| 52 | 2.61 | ○ | ○ | blue |
| 53 | 2.50 | ○ | ○ | blue |
| 54 | 2.43 | ○ | ○ | blue |
| 55 | 2.56 | ○ | ○ | blue |
| 56 | 2.44 | ○ | ○ | blue |
| 57 | 2.55 | ○ | ○ | blue |
| 58 | 2.55 | ○ | Δ | blue |
| 59 | 2.46 | ○ | Δ | blue |
| 60 | 2.61 | ○ | Δ | blue |
| 61 | 2.58 | ○ | Δ | blue |
| 62 | 2.48 | ○ | ◎ | blue |
| 63 | 2.83 | ○ | Δ | blue |
| 64 | 2.57 | ○ | ○ | blue |
| 65 | 2.73 | ○ | ◎ | blue |
| 66 | 2.69 | ○ | ◎ | blue |
| 67 | 2.59 | ○ | ◎ | blue |
| 68 | 2.65 | ○ | ◎ | blue |
| 69 | 2.95 | ○ | ◎ | blue |
| 70 | 2.34 | ○ | ◎ | blue |
| 71 | 2.43 | ○ | ◎ | blue |
| 72 | 2.47 | ○ | ◎ | blue |
| 73 | 2.39 | ○ | ◎ | blue |
| 74 | 2.52 | ○ | ◎ | blue |
| 75 | 2.55 | ○ | ◎ | blue |
| 76 | 2.34 | ○ | ◎ | blue |
| 77 | 2.09 | ○ | ◎ | blue |
| 78 | 2.22 | ○ | ◎ | blue |
| 79 | 2.44 | ○ | ◎ | blue |
| 80 | 2.36 | ○ | ◎ | blue |
| 81 | 2.37 | ○ | ◎ | blue |
| 82 | 2.54 | ○ | ◎ | blue |
| 83 | 2.55 | ○ | ◎ | blue |
| 84 | 2.43 | ○ | ○ | blue |

COMPARATIVE EXAMPLES 1-5

The procedures of Example 1 were followed with the exception that the dyes set out in Table 3 were used. The results are reported in Table 3.

TABLE 3

| Comparative Examples | Density of Developed colors | Storability A | Storability B | Color tone |
|---|---|---|---|---|
| 1 | 0.99 | X | Δ | Blue |
| 2 | 1.16 | Δ | Δ | Blue |
| 3 | 2.07 | X | Δ | Blue |
| 4 | 1.12 | Δ | Δ | Blue |
| 5 | 1.02 | X | Δ | Indigo |

A: Resistance to heat migration
B: Light fastness
Comparative Ex.
1: C.I. Disperse Blue 14
2: C.I. Disperse Blue 134
3: C.I. Solvent Blue 63
4: C.I. Disperse Blue 26
5: C.I. Disperse Violet 43
It is noted that the aforesaid density of developed colors was obtained with Densitometer RD-918 made by Macbeth Co., Ltd. U.S.A.).

The resistance to heat migration was measured by allowing the image to stand in a 70° C. atmosphere for 48 hours. A double circle indicates that the image suffered no change in sharpness and white paper was not colored even when the image was rubbed on its surface with it; a circle indicates that the image suffered a slight change in sharpness and white paper was slightly colored; a triangle indicates that the image lost sharpness and white paper was colored; and a cross indicates that the image became blurry and white paper was badly colored.

The light fastness was determined by allowing the image to be irradiated with light from an xenon light source until a third grade piece of a blue scale was colored. A double circle indicates that no discoloration took place at all; a circle indicates that slight discoloration took place; and a triangle indicates that serious discoloration took place.

INDUSTRIAL APPLICABILITY

The heat transfer sheets according to this invention can find wide applications in printing and image-making with heat transfer systems.

What is claimed is:

1. A heat transfer sheet comprising:

a substrate sheet; and a dye carrier layer formed on one surface of said substrate sheet, the dye included in said dye carrier layer comprising a dye represented by the following general formula (I):

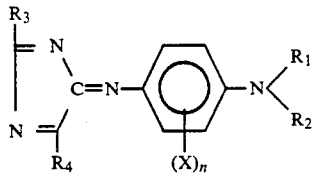

(I)

wherein:

$R_1$ and $R_2$ each stand for an identical or different substituted or unsubstituted alkyl, cycloalkyl, aralkyl or aryl group or an atom or atomic group forming a five- or six-membered ring together with X, provided that $R_1$ and $R_2$ may form together a five- or six-membered ring which may contain an oxygen or nitrogen atom;

$R_3$ and $R_4$ each represent an identical or different substituted or unsubstituted phenyl or naphthyl group or a heterocyclic group containing at least one of oxygen, nitrogen and sulfur atoms, with the proviso that $R_3$ and $R_4$ cannot be phenyl groups at the same time;

X indicates a hydrogen atom, a halogen atom, a cyano group or a nitro group, or an alkyl, cycloalkyl, alkoxy, aryl, aralkyl, acylamin-o, sulfonylamino, ureido, carbamoyl, sulfamoyl, acyl or amino group which may have a substituent; and n is an integer of 1 or 2.

2. A heat transfer sheet as claimed in claim 1, wherein $R_4$ is a substituted or unsubstituted thienyl group.

3. A heat transfer sheet as claimed in claim 1, wherein $R_3$ and $R_4$ are identical or different, substituted or unsubstituted thienyl groups.

4. A heat transfer sheet as claimed in claim 1, wherein the dye has a molecular weight of 400 or more.

5. A heat transfer sheet as claimed in claim 1, wherein at least one of the groups $R_1$–$R_4$ and X contains a polar substituent.

6. A heat transfer sheet as claimed in claim 1, wherein the half-width of the maximum absorption wavelength of the dye in a visible light absorption spectrum is 130 nm or less in terms of reflection.

* * * * *